US007722308B2

(12) United States Patent
Sakitani et al.

(10) Patent No.: US 7,722,308 B2
(45) Date of Patent: May 25, 2010

(54) CONSTRUCTION MACHINE

(75) Inventors: Shintaro Sakitani, Hiroshima (JP); Sachiko Watanabe, Hiroshima (JP); Tomohiko Ochi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 126 days.

(21) Appl. No.: 11/765,731

(22) Filed: Jun. 20, 2007

(65) Prior Publication Data

US 2008/0014070 A1 Jan. 17, 2008

(30) Foreign Application Priority Data

Jul. 12, 2006 (JP) ..... 2006-192056

(51) Int. Cl.
*B66C 23/00* (2006.01)

(52) U.S. Cl. ..... 414/680

(58) Field of Classification Search ..... 414/680, 414/685, 686, 687; 180/6.58, 89.11, 89.17; 29/700, 891, 891.1
See application file for complete search history.

(56) References Cited

U.S. PATENT DOCUMENTS 2,438,424 A * 3/1948 Swenson ..... 29/891.1
4,056,250 A * 11/1977 Uchiyama ..... 248/674
6,134,816 A 10/2000 Murakami et al.
2005/0000746 A1* 1/2005 Imashige ..... 180/69.24

FOREIGN PATENT DOCUMENTS

| | | |
|---|---|---|
| EP | 1 367 181 A2 | 12/2003 |
| GB | 1 475 202 | 6/1977 |
| JP | 4-181009 | 6/1992 |
| JP | 10-18347 | 1/1998 |
| JP | 2000-291056 | 10/2000 |
| JP | 2002-256593 | 9/2002 |
| JP | 2004-116102 | 4/2004 |

* cited by examiner

*Primary Examiner*—Donald Underwood
(74) *Attorney, Agent, or Firm*—Oblon, Spivak, McClelland, Maier & Neustadt, L.L.P.

(57) ABSTRACT

On the laterally opposite side of an upper frame constructing an upper rotating body to a cabin, are installed devices in a state that a pin insertion and removal space sufficient for inserting and removing a boom foot pin in the axial direction is ensured, and in a bracket provided in the pin insertion and removal space, is provided a pin guide in a square tube shape for guiding the boom foot pin in the insertion and removal direction.

5 Claims, 6 Drawing Sheets

CONSTRUCTION MACHINE

BACKGROUND OF THE INVENTION

1. Field of the Invention

The present invention relates to a construction machine provided with a construction for inserting and removing a boom foot pin such as a hydraulic excavator.

2. Description of the Related Art

The related art will be described with an example of a hydraulic excavator which is a preferred example of the present invention.

An upper rotating body of the hydraulic excavator is provided with an upper frame. A cabin is installed on one of left and right sides (generally on the left side) of the upper frame. A pair of left and right boom attachment frames are provided on the inner side of the upper frame to the cabin (on the middle part in the lateral direction). A base end of the boom (boom foot) is attached to the boom attachment frames by a boom foot pin.

On the opposite side (on the right side) of the upper frame to the cabin, a side cover is provided on a side surface part, and a front cover is provided on a part covering a front surface part and an upper surface part, respectively. In a device chamber covered by both the covers on the front-right side, are installed various devices including a working oil tank.

The boom is attached to and detached from the upper rotating body at the time of transportation of the machine, maintenance and the like. In this case, since the cabin is located on the left side of the boom foot pin as mentioned above, the boom foot pin is inserted and removed only from the right side.

However, on an extended line of an axis of the boom foot pin (hereinafter, referred to as pin insertion and removal line), is located the working oil tank disturbing the insertion and removal of the pin.

Therefore, there are proposed means that a through hole sufficient for inserting and removing the boom foot pin is provided in the working oil tank (Known Technique 1), or, as disclosed in Japanese Patent Laid-Open Nos. Hei10-18347 and 2000-291056, means that the devices such as a tank is installed at a position apart from the pin insertion and removal line in the device chamber so that a pin insertion and removal space is ensured on the pin insertion and removal line (Known Technique 2).

However, in Known Technique 1, with a complicated shape of the working oil tank, troublesome processing and high cost, there is a fear that the tank is damaged when the pin is inserted or removed. Since there are a lot of harmful effects as mentioned, Known Technique 1 is not the best idea.

Meanwhile, according to Known Technique 2, since the devices are not changed, the problem in Known Technique 1 can be solved. However, since the boom foot pin is not supported in the pin insertion and removal space, there occurred new problems that when the pin is inserted and removed (particularly when removed), the boom foot pin is inclined from the pin insertion and removal line and brought into contact with surrounding structures such as hydraulic piping, or the pin is dropped off as soon as removed from the boom attachment frames so that the pin itself and the structures are damaged.

SUMMARY OF THE INVENTION

It is an object of the present invention to provide a construction machine capable of preventing contact of a boom foot pin with surrounding structures and drop-off of the pin when the pin is inserted and removed, based on a construction for ensuring a pin insertion and removal space.

Firstly, the construction machine according to the present invention has the following basic construction.

That is, the construction machine of the present invention comprises an upper rotating body mounted on the lower traveling body rotatably around a vertical axis, a cabin installed on one of left and right sides of an upper frame constructing the upper rotating body, a boom whose base end is attached to the upper frame by a boom foot pin on the inner side of the upper frame to the cabin, and various devices installed on the upper frame, and the devices are installed on the laterally opposite side of the upper frame to the cabin in a state that a pin insertion and removal space sufficient for inserting and removing the boom foot pin in the axial direction is ensured. Further, the construction machine of the present invention comprises pin guide for guiding the boom foot pin in the insertion and removal direction, the pin guide being provided in the pin insertion and removal space.

According to the present invention, since the pin insertion and removal space is ensured on the opposite side (on the right side in the above example) of the cabin on the upper frame, and then the pin guide for guiding the boom foot pin in the insertion and removal direction is provided in the pin insertion and removal space, there is no fear that when the pin is inserted and removed, the boom foot pin is brought into contact with the surrounding structures such as hydraulic piping and the pin is dropped off, and hence it is possible to surely preventing damage of the pin itself and the structures.

DESCRIPTION OF THE PREFERRED EMBODIMENTS

Embodiments of the present invention will be described with reference to FIGS. 1 to 6.

Figure 1:
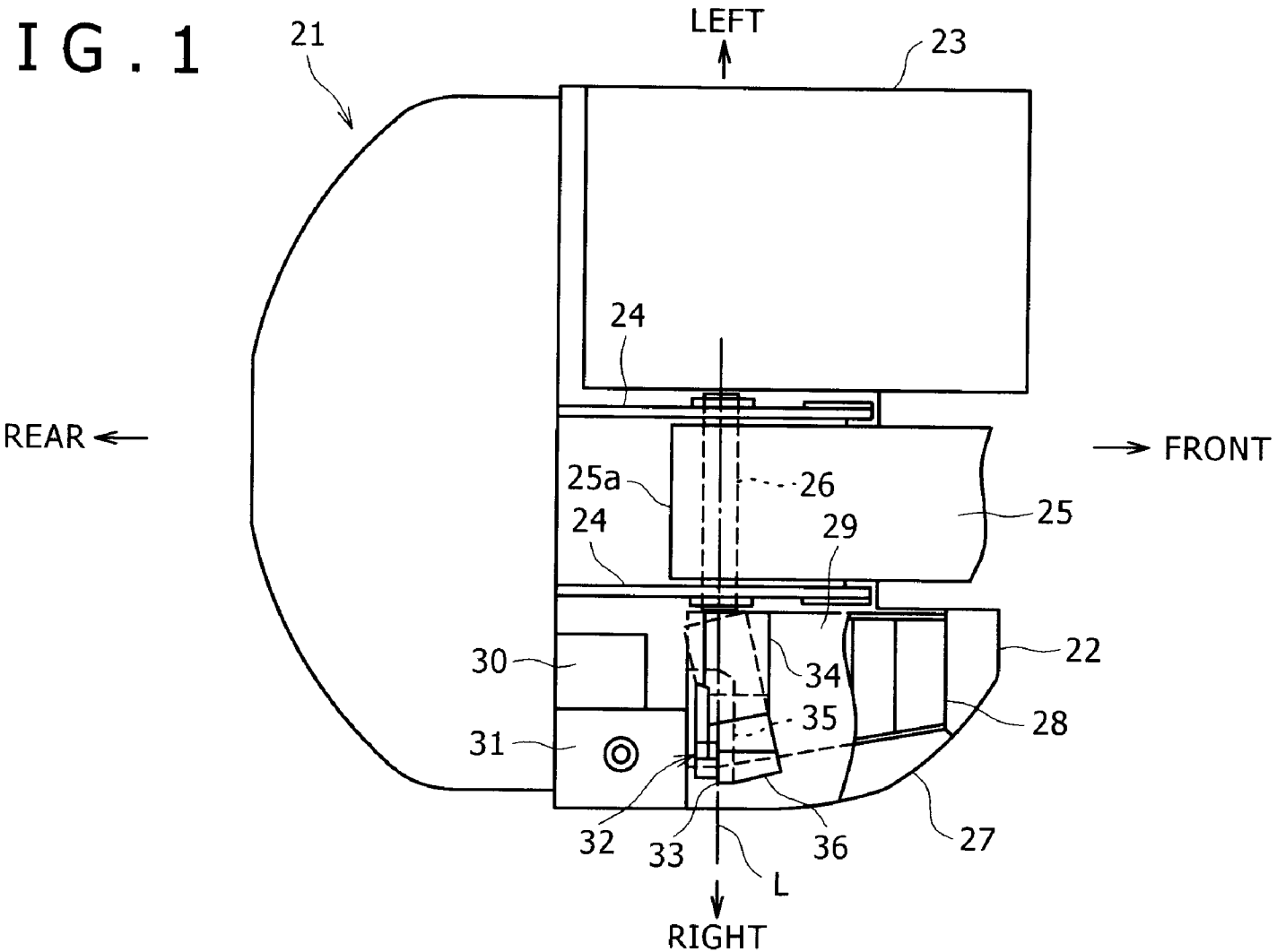
FIG. 1 is a plan view of an upper rotating body of a hydraulic excavator according to an embodiment of the present invention.
Figure 2:
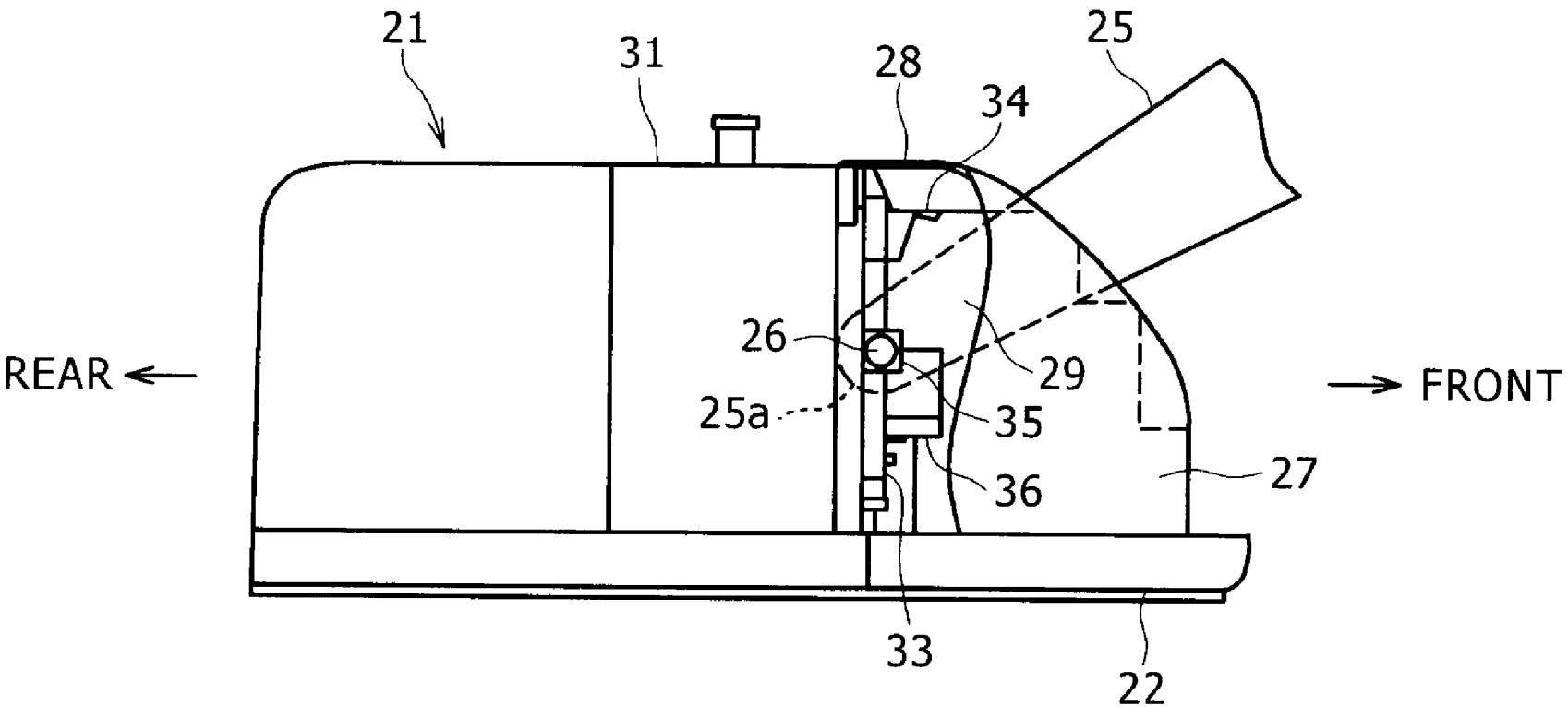
FIG. 2 is a partially notched side view of the upper rotating body of the hydraulic excavator according to the embodiment of the present invention.
Figure 3:
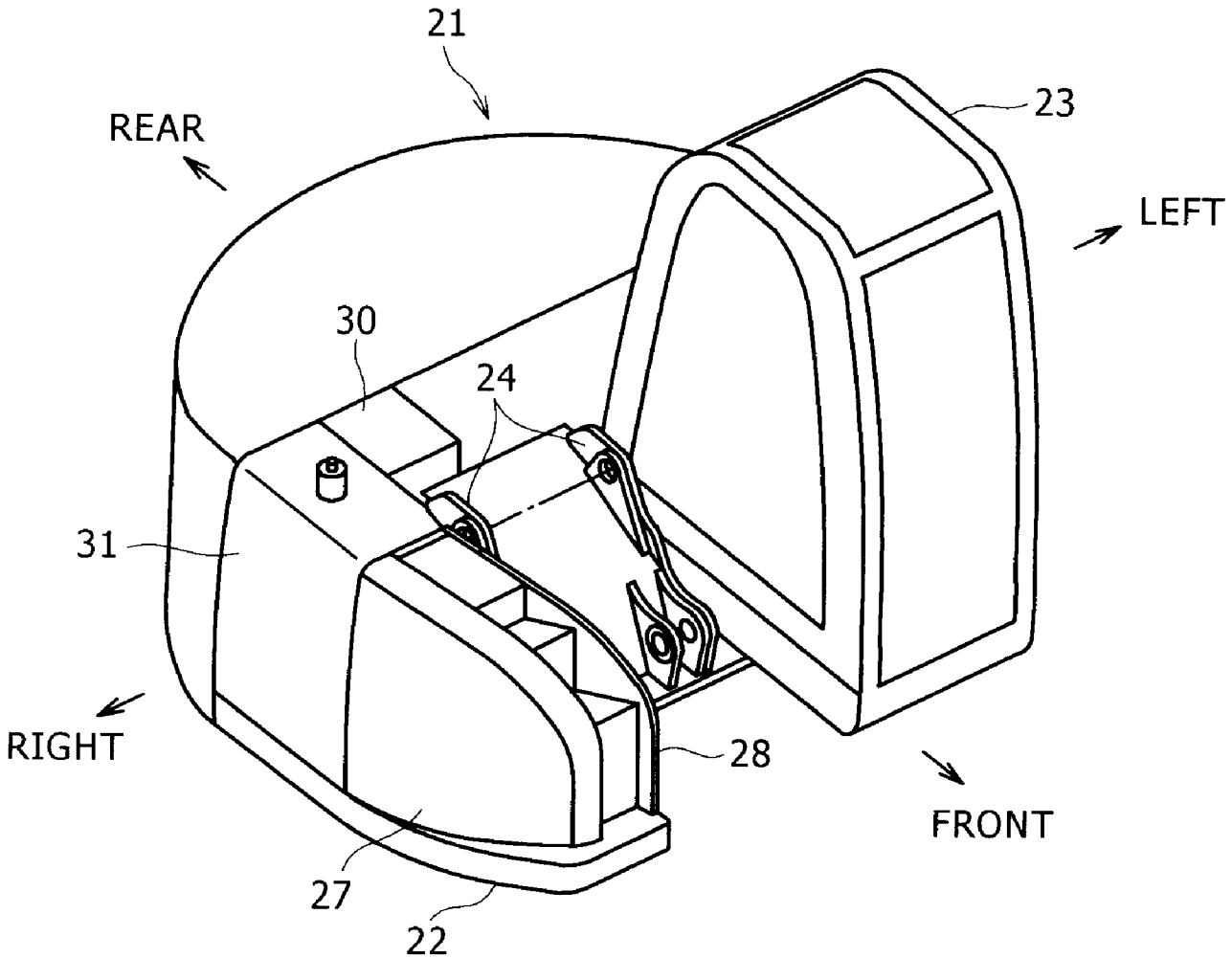
FIG. 3 is a perspective view of the upper rotating body of the hydraulic excavator according to the embodiment of the present invention.

The embodiments are exemplified in a case where the present invention is applied to a hydraulic excavator. An upper rotating body 21 of the hydraulic excavator is shown in FIGS. 1 to 3.

Figure 7:
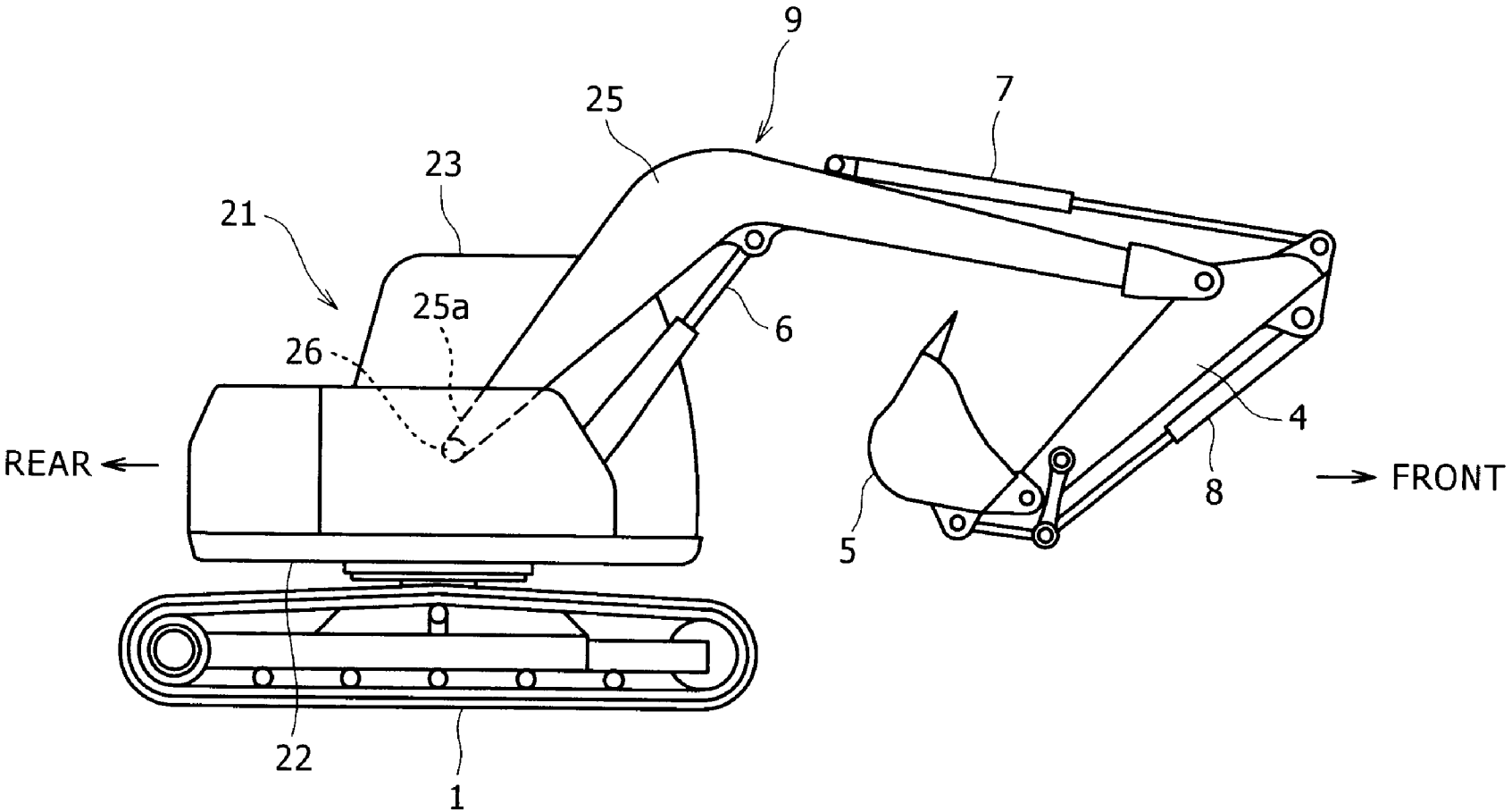
FIG. 7 is an overall side view of a hydraulic excavator to which the present invention is applied.

A basic construction of the upper rotating body 21 is shown in FIG. 7. On a crawler type lower traveling body 1, is installed the upper rotating body 21 rotatably around a vertical axis. To a front part of the upper rotating body 21, is attached a working attachment 9 provided with a boom 25, an arm 4, a bucket 5 and hydraulic cylinders (boom cylinder, arm cylinder, bucket cylinder) 6, 7 and 8 for operating the boom, the arm and the bucket.

That is, the upper rotating body 21 is provided with an upper frame 22, and on the left side of the upper frame 22, is installed a cabin 23. On the inner side of the upper frame to the cabin 23 (on the middle part in the lateral direction), are provided a pair of left and right boom attachment frames 24. To the boom attachment frames 24, is attached a base end (boom foot) 25*a* of the boom 25 by a boom foot pin 26. It should be noted that the attachment frames 24 are omitted in FIG. 2 for simplification of the figure.

On a right side surface part of the upper frame 22, is provided a side cover 27, and on a part covering a front surface part and an upper surface part, is provided a front cover 28 respectively. In a device chamber 29 covered by both the covers 27 and 28, are installed various devices, while on the rear side of the device chamber 29, are laterally aligned a fuel tank 30 and a working oil tank 31.

The devices in the device chamber 29 are installed in a state that a pin insertion and removal space (no specific reference numeral) sufficient for inserting and removing the pin 26 is ensured around an insertion and removal line L of the boom foot pin 26. In the pin insertion and removal space, to the upper frame 22, is attached a bracket 32 serving as a support body for attaching both the covers 27 and 28.

Figure 4:
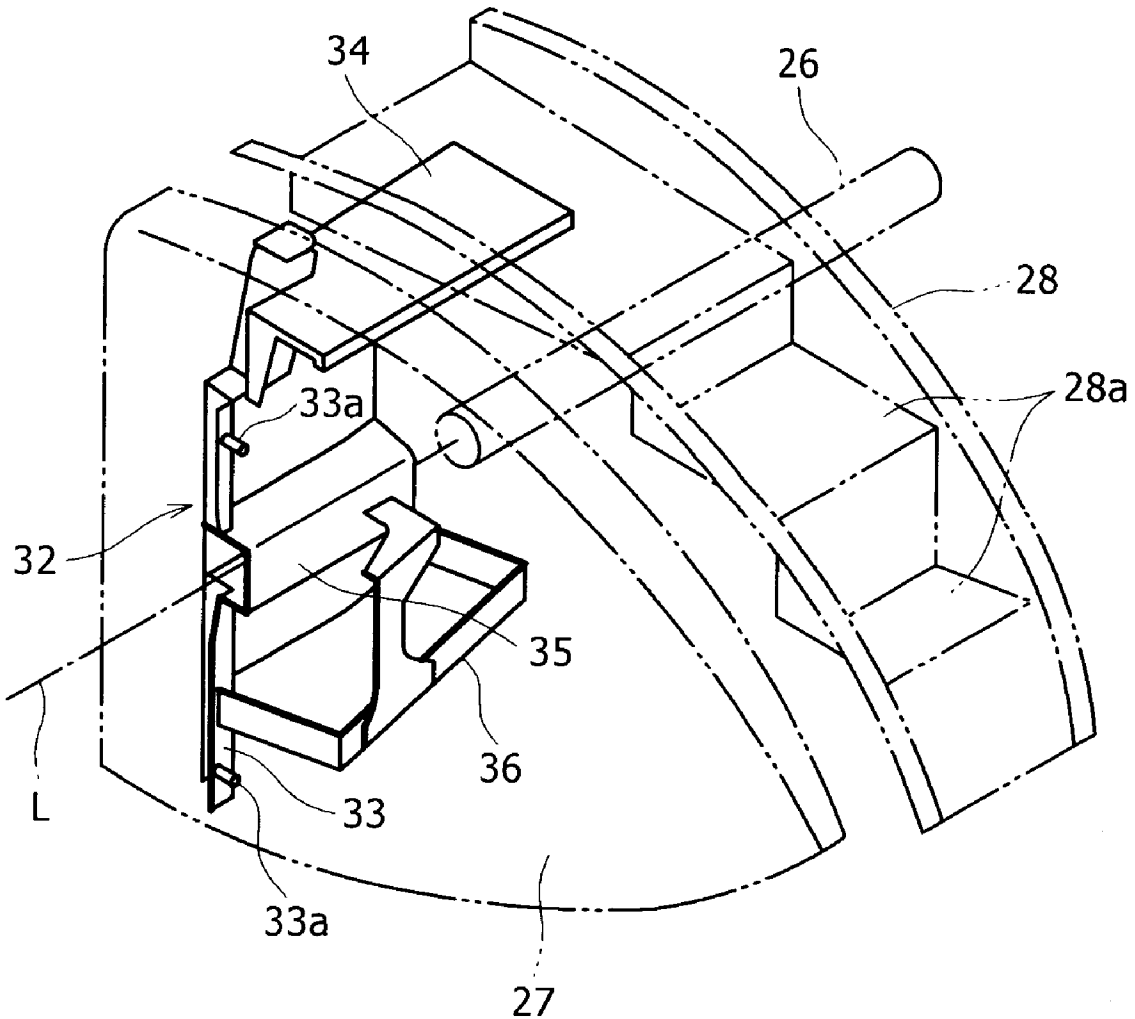
FIG. 4 is a perspective view of a bracket provided with a pin guide.
Figure 5:
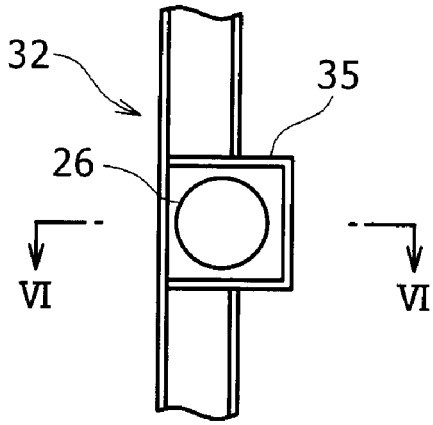
FIG. 5 is a partially enlarged view of FIG. 2.
Figure 6:
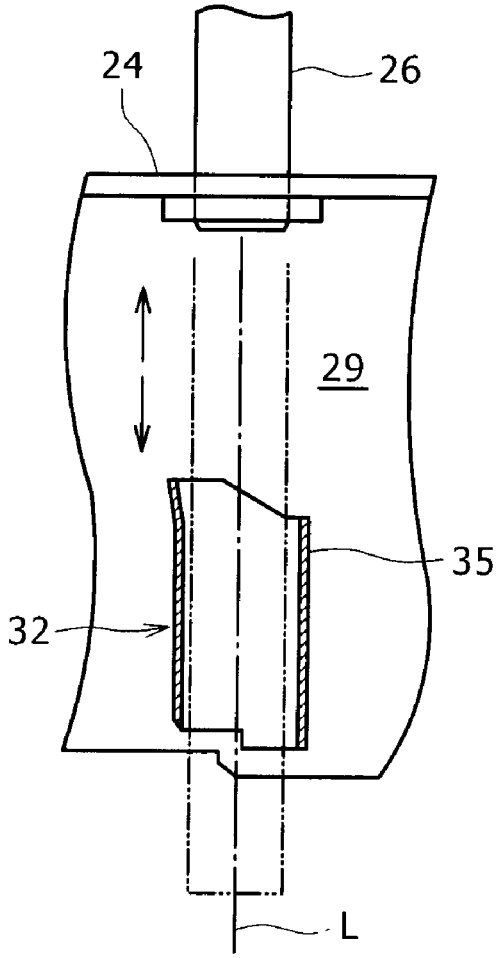
FIG. 6 is a sectional view by line VI-VI of FIG. 5.

In the bracket 32, as shown in FIG. 4 and the like, are provided a side cover attachment portion 33 provided with hinge attachment pins 33*a* (refer to FIG. 4) to which a hinge (not shown) serving as support point for opening and closing the side cover 27 is attached, and a front cover attachment portion 34 to which the front cover 28 is attached.

The front cover 28 is constructed as a cover also serving as steps, as provided with several up and down steps 28*a* for performing maintenance of parts from the upper surface side of the machine. An upper part of the front cover 28 is attached to and supported by the front cover attachment portion 34.

In a middle part of the bracket 32 in the height direction, is provided a pin guide 35 on the pin insertion and removal line L.

The pin guide 35 is formed in a horizontal and square tube shape having a section size enabling insertion of the boom foot pin 26 in the axial direction. When the pin is inserted and removed, the boom foot pin 26 is guided to the insertion and removal direction by the pin guide 35.

That is, the boom foot pin 26 is pulled out to the right side and inserted from the right side in a state that the side cover 27 is opened.

In this case, while pulled out from the attachment frames 24, the pin 26 is fitted into the pin guide 35 (refer to FIG. 6), and supported and guided by the pin guide 35. When the pin is inserted, while supported and guided by the pin guide 35, the pin 26 is inserted into the attachment frames 24.

By the supporting and guiding effect of the pin guide 35, the boom foot pin 26 is inserted and removed on the pin insertion and removal line L and there is no fear that the pin is inclined from the pin insertion and removal line L. Therefore, since there is no fear that, when the pin is inserted and removed, the pin 26 is brought into contact with surrounding structures such as hydraulic piping and dropped off, it is possible to surely preventing damage of the pin itself and the structures.

In the device chamber 29 covered by both the side cover 27 and the front cover 28, is formed the pin insertion and removal space, and in the bracket 32 provided in the pin insertion and removal space, are provided the pin guide 35 and the attachment portions 33 and 34 of both the side cover 27 and the front cover 28. In other words, the pin guide 35 is provided in the bracket 32 which is originally required as a structure for attaching the cover. Therefore, in comparison to a case where the pin guide 35 is independently provided, it is possible to simplify a construction within the device chamber 29 and to lower the cost.

In addition, it is possible to strengthen the bracket 32 by the pin guide 35 and enhance the strength as the structure for attaching the cover.

Further, in the present embodiment, focusing on a point that when the side cover 27 is opened, the inside of the device chamber 29 including the bracket 32 is opened to the outside, on the lower side of the pin guide 35 in the bracket 32, is disposed a tool box 36 so that various tools are taken in and out from the outside.

By this, the bracket 32 can be multi-functionalized and intensified, and the construction within the device chamber 29 can further be simplified.

Other Embodiments (1) The above embodiment is exemplified in a case where the front cover 28 also serving as steps is attached to the part covering the front surface and the upper surface of the device chamber 29. However, a front cover only for covering without steps may be attached.

Further, a fuel supply unit provided with a fuel supply hose and a fuel supply pump for fueling the fuel tank 30 may be attached to the front cover attachment portion 34 in the above embodiment. In this case, the front cover 28 may be attached by overlapping an upper surface of the fuel supply unit, or attached to the front cover attachment portion separately provided in the bracket 32.

(2) In the above embodiment, the bracket 32 is provided with three parts including the pin guide 35, both the side cover and front cover attachment portions 33 and 34, and the tool box 36. However, only two of the three parts or one of the three parts may be provided. An attachment portion for attaching other equipment in addition to the three parts may be added.

(3) Essentially, the shape of the pin guide 35 is anything which is capable of supporting and guiding the boom foot pin 26. Therefore, it is possible to select not only a square tube shape but also a cylindrical shape or the like accordingly.

Although the invention has been described with reference to the preferred embodiments in the attached figures, it is noted that equivalents may be employed and substitutions made herein without departing from the scope of the invention as recited in the claims.

We claim:

1. A construction machine, comprising:

a lower traveling body;

an upper rotating body mounted on said lower traveling body rotatably around a vertical axis;

a cabin installed on one of left and right sides of an upper frame constructing said upper rotating body;

a boom whose base end is attached to said upper frame by a boom foot pin on the inner side of said upper frame relative to said cabin, the boom foot pin being inserted through said boom base end and upper frame in the direction of the axial length of the boom foot pin;

at least one operational device installed on said upper frame on a side of said upper frame laterally opposite to said cabin and arranged to provide a pin insertion and removal space along the path of movement of the boom foot pin during inserting of the boom foot pin, which pin insertion and removal space is sufficient for inserting and removing said boom foot pin;

a support element fixed relative to said upper rotating body and adapted to pivotally support at least one cover covering a device chamber of said upper rotating body; and a tubular pin guide provided on said support element, and provided in said device chamber and in said pin insertion and removal space, said pin guide having portions engageable with opposing sides of the boom foot pin when the boom foot pin is inserted in the insertion path of movement of the boom foot pin, for guiding said boom foot pin in the insertion path of movement of the boom foot pin.

2. A construction machine comprising:

a lower traveling body;

an upper rotating body mounted on said lower traveling body rotatably around a vertical axis;

a cabin installed on one of left and right sides of an upper frame constructing said upper rotating body;

a boom whose base end is attached to said upper frame by a boom foot pin on the inner side of said upper frame relative to said cabin, the boom foot pin being inserted through said boom base end and upper frame in the direction of the axial length of the boom foot pin;

at least one operational device installed on said upper frame on a side of said upper frame laterally opposite to said cabin and arranged to provide a pin insertion and removal space along the path of movement of the boom foot pin during inserting of the boom foot pin, which pin insertion and removal space is sufficient for inserting and removing said boom foot pin;

a support element fixed relative to said upper rotating body and adapted to pivotally support at least one cover covering a device chamber of said upper rotating body;

a pin guide provided on said support element, and provided in said device chamber and in said pin insertion and removal space, for guiding said boom foot pin in the insertion path of movement;

a side cover for covering a side surface part on the laterally opposite side of said upper frame to said cabin;

a front cover for covering a front surface and an upper surface of the laterally opposite side to said cabin, said pin insertion and removal space being formed within the device chamber covered by both said side cover and said front cover, wherein at least one of said side cover and said front cover comprises said at least one cover; and a bracket provided in said pin insertion and removal space and comprising said support element.

3. The construction machine according to claim 2, wherein said device chamber is constructed so as to open to the outside by openably attaching said side cover, and a tool box is disposed in said bracket so that tools may be taken in and out from the outside.

4. The construction machine according to claim 1, wherein said pin guide is elongated in the direction of the path of movement of the boom foot pin during inserting of the boom foot pin.

5. The construction machine according to claim 2, wherein said pin guide is elongated in the direction of the path of movement of the boom foot pin during inserting of the boom foot pin.

* * * * *